US007406977B1

(12) United States Patent
Shires

(10) Patent No.: US 7,406,977 B1
(45) Date of Patent: Aug. 5, 2008

(54) LIGHTWEIGHT SHELTER

(76) Inventor: Henry C. Shires, 330 Belmont Ave., Redwood City, CA (US) 94061

( * ) Notice: Subject to any disclaimer, the term of this patent is extended or adjusted under 35 U.S.C. 154(b) by 137 days.

(21) Appl. No.: 11/029,777

(22) Filed: Jan. 5, 2005

(51) Int. Cl.
*E04H 15/18* (2006.01)
*E04H 15/34* (2006.01)
*E04H 15/32* (2006.01)

(52) U.S. Cl. ..... 135/97; 135/121; 135/115; 135/120.4

(58) Field of Classification Search ..... 135/119, 135/115, 171, 120.4, 121, 97, 136, 138, 114
See application file for complete search history.

(56) References Cited

U.S. PATENT DOCUMENTS

| | | | | | |
|---|---|---|---|---|---|
| 602,587 | A * | 4/1898 | Phelps | 135/121 |
| 1,057,628 | A * | 4/1913 | Eberhardt | 135/97 |
| 2,258,084 | A * | 10/1941 | Baker | 135/97 |
| 3,060,949 | A * | 10/1962 | Moss | 135/87 |
| 4,719,934 | A * | 1/1988 | Mydans | 135/90 |
| 4,829,694 | A * | 5/1989 | Oasheim | 43/1 |
| 4,941,422 | A * | 7/1990 | Muller | 114/203 |
| 5,197,505 | A * | 3/1993 | Tate | 135/123 |
| 5,477,876 | A * | 12/1995 | Moss | 135/97 |
| 6,289,834 | B1 * | 9/2001 | Phillips | 114/211 |
| 2001/0042563 | A1 * | 11/2001 | Coupounas | 135/124 |
| 2002/0134415 | A1 * | 9/2002 | Boulange | 135/117 |

OTHER PUBLICATIONS

Tarptent, Ultralight Shelters, website catalog pages showing 2003 model shelters, 7 pages, www.tarptent.com, Redwood City, California, U.S.

* cited by examiner

*Primary Examiner*—David R Dunn
*Assistant Examiner*—Tania Abraham
(74) *Attorney, Agent, or Firm*—Northern Michigan Patent Law, PLC

(57) ABSTRACT

The present invention is an improved tensioned canopy shelter of the type used by backpackers. The canopy of the new shelter has a lower rear support and a higher front pole support with a horizontal ridge strut. The ridge strut spreads the forward end of the canopy's ridgeline into a catenary-tensioned panel, with dual catenary curves running from the ends of the ridge strut to the rear end of the canopy. The horizontal ridge strut can be supported by a single central upright pole, or it can alternately be supported at its ends by spaced upright poles for even greater stability and easier entry and exit through the front of the shelter, for example using two trekking-type poles. In the preferred form the ridge strut is provided with pole connections to allow either the single- or double-pole options. In a further preferred form, the ridge strut is removably held in a sleeve in such a manner that it may either be left in place or removed when the shelter is rolled up for storage. In yet a further form, the ridge strut provides structural support for an adjustable ventilation flap.

20 Claims, 7 Drawing Sheets

LIGHTWEIGHT SHELTER

FIELD OF THE INVENTION

The present invention is in the field of tent and tarp type shelters used by hikers and campers.

DESCRIPTION OF RELATED ART

Hikers and campers, especially backpackers, usually require a shelter such as a tent for overnight or multi-night trips. The longer the trip, the greater the need for a shelter of as little packed weight as possible to reduce fatigue, to make room for food and other gear, and to increase the enjoyment of hiking.

Tents tend to be one of the heaviest items in the pack, and many hikers opt for lighter, less-protective tarps or floorless shelters such as nylon pyramids for the weight savings alone. Even "single-wall" tents, with only one layer of waterproof canopy fabric (rather than spaced layers of breathable and waterproof fabric), tend to be heavier than tarps due to the tents' flooring and heavier structural components. Moreover, single-wall tents tend to be known for condensation problems, where exhaled and evaporated moisture from the occupants condenses on the inner surface of the fabric and either drips or runs down the walls onto the floor. Solutions to the condensation problem such as inner wicking surfaces and vents tend to increase weight, and have limits in certain environmental conditions.

Other factors in choosing a tarp shelter over a tent seem to be the preference among many hikers for a more open, airy, close-to-nature experience while sheltering and sleeping outdoors, and the absence of any need to care for an attached floor and keep it clean. The primary drawbacks of tarp shelters are their lack of structural stability in wind, and their lack of insect protection as they are typically floorless and without insect netting.

A hybrid solution to the foregoing problems has been to apply netting in some fashion to tarp style shelters, with mixed success. Detachable netting inserts, defining floored or floorless screened enclosures within the protective tarp canopy, tend to add undesirable weight back into the system. Fixed netting sewn along the tarp perimeter and hanging to the ground provides some protection, but the lack of tensioning and supporting structure in even a well-rigged tarp mitigates some of the benefit. And, finally, tarps simply lack the tent-like structural strength and protection that many hikers find preferable.

An early solution to the foregoing problems was my original Tarptent™ shelter. This combined features of tarps and tents, with a pole-supported, tensioned, tent-style waterproof canopy using lightweight material, and front and rear doors and a sidewall made from insect netting to reduce condensation and provide bug protection.

A second version of the Tarptent™ shelter offered improved structural strength and ventilation using a waterproof canopy raised fully off the ground, a catenary curved ridgeline, and a tensioned, inwardly-angled rear arch pole in place of the previous upright rear pole. The rear arch was staked out with a single stake anchoring three tensioned guylines running from a rear arch awning.

Yet further versions of the Tarptent™ canopy shelters have lower, outwardly-angled rear arch supports tensioning catenary ridgelines against higher, vertical front supports, in one instance a straight pole, and in another instance a front arch pole. These shelters are the subjects of my co-pending U.S. patent application Ser. Nos. 10/673,285 and 10/673,286 filed Sep. 30, 2003.

The Tarptent™ shelters are nominally floorless, having a raised-off-the-ground, tensioned canopy structure where a floor is either absent, or is attached to but not structurally part of the raised, tensioned canopy structure. The shelters are primarily intended as floorless shelters for simplicity and weight savings, with lightweight, removable groundcloths preferably used over the bare-ground "footprint" preferably bounded by drop-down netting sidewalls and front and rear netting panels. Floors, however, can be optionally added by sewing them to the hanging netting.

BRIEF SUMMARY OF THE INVENTION

The present invention is an improved tensioned canopy shelter of the type generally described above. The canopy of the new shelter is raised and tensioned at its forward end with a pole-supported horizontal ridge strut. The ridge strut spreads the forward end of the canopy's ridgeline into a catenary-tensioned panel, with dual catenary curves running from the ends of the ridge strut to the rear arch of the shelter. The result is a shelter that is more stable, is easier to set-up, has more interior space and improved ventilation, and has multiple pitch options.

The horizontal ridge strut can be supported by a single central upright pole and provide exceptional canopy stability. The ridge strut can alternately be supported at its ends by spaced upright poles for even greater stability and easier entry and exit through the front of the shelter, for example using two trekking-type poles. In the preferred form the ridge strut is provided with pole connections to allow either the single- or double-pole options. In a further preferred form, the ridge strut is removably held in a sleeve in such a manner that it may either be left in place or removed when the shelter is rolled up for storage. In yet a further form, the ridge strut provides structural support for an adjustable ventilation flap.

The front support allows the shelter to be optionally set up with only three stakes without limiting ease of entry or exit, reducing the shelter's packed weight, and without sacrificing stability.

These and other features and advantages of the invention will become apparent upon further reading of the specification and accompanying drawings.

DETAILED DESCRIPTION OF THE INVENTION

Figure 1:
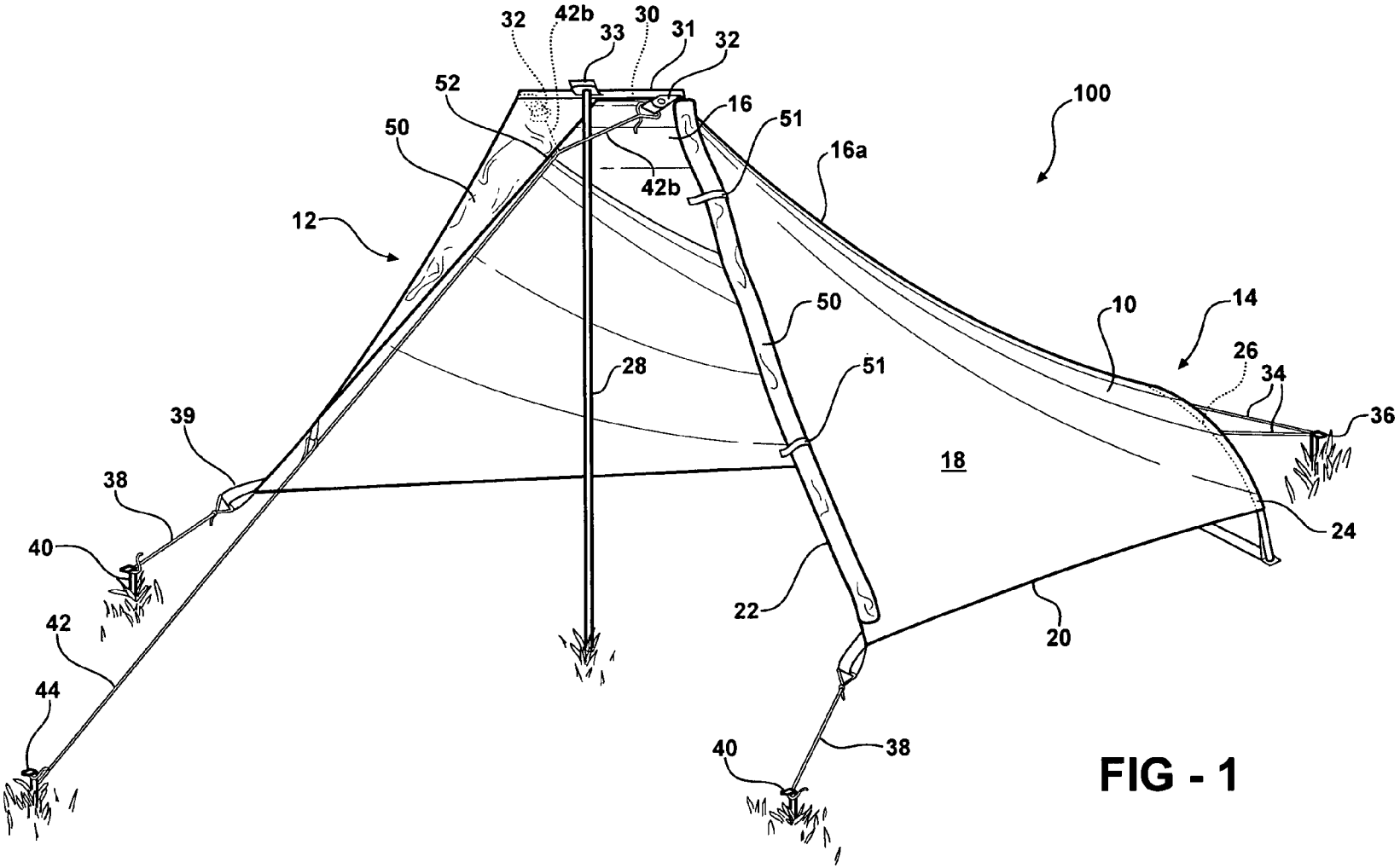
FIG. 1 is a perspective front view of a shelter according to the present invention.

Referring first to FIG. 1, a shelter 100 according to the invention is shown in a basic floorless canopy form, having a tensioned canopy 10 supported above the ground by a rear arched pole 26 in a manner disclosed in my co-pending U.S. application Ser. Nos. 10/673,285 and 10/673,286, and by a front upright pole 28. Preferred options such as insect netting sidewalls and doors and groundcloths or floors will typically be used but are omitted from FIG. 1 for clarity and to focus on the tensioned canopy structure. An optional but preferred front awning or beak 50 is shown with one side rolled back. The structure and use of such preferred options are disclosed in my earlier co-pending applications.

Canopy 10 is made from a lightweight, weather-resistant (preferably waterproof material such as silicone-coated or silicone-impregnated nylon, often referred to as silnylon or parachute cloth or sailcloth, usually with a weight of less than two ounces per square yard. It will be understood by those skilled in the art that other known materials can be used, including but not limited to polyurethane coated nylon and polyester fabrics and waterproof/breathable fabrics commonly used for tents and tarps. Canopy 10 has a higher front end 12 defining a door for entry into and exit from the shelter, a lower rear end 14, and a ridgeline panel 16 descending in a catenary curve from the higher front end to the lower rear end. The advantages of the catenary curve in tent and tarp structures is generally known in the art, a primary advantage being the tautness given the fabric between supporting poles or tension points. Ridgeline 16 divides the canopy into identical sidewall portions 18, whose lower edges 20 are spaced from the ground when the shelter is properly supported on the front and rear poles, as shown. Lower edges 20 and front and rear canopy edges 22 and 24 are preferably also cut with catenary curves to increase fabric tautness when tensioned between poles and guylines. While the supporting poles could be sized to place the lower edges of the canopy in contact with the ground for increased weather protection and privacy, it is preferred with such shelters to space the canopy edges from the ground for ventilation and a more open feeling for the occupants. And while the rear end of the shelter is preferably raised off the ground by the preferred arch pole structure illustrated, it would be possible to support the rear end of such a shelter with a different pole structure or in some other known fashion. It would even be possible to manufacture the shelter canopy such that the rear end of the shelter could be staked directly to the ground, although ventilation would be reduced at the rear of the shelter.

The shelter structure 100 defined by canopy 10 and its poles 26 and 28 is held in tension by guylines running from the supporting poles and from select points on the canopy to stakes driven into the ground. Rear arch pole 26 is tensioned by guylines 34 extending from spaced points on the rear of the canopy, for example from the fabric sleeve in which the pole is inserted, or from a flap or awning extension from the pole sleeve, to a single rear stake 36. The front lower corners of the canopy are tensioned by guylines 38 secured to grommets or loops 39 and extending to stakes 40. Front upright support pole 28 is tensioned by a central guyline 42 connected to ridge strut 30 and extending to stake 44. The lower side edges and other points on the canopy could be provided with additional guy-out points for increased tension in some extreme conditions, but they are generally believed to be unnecessary given the superb stability of shelter 100 with the basic stake and tensioning lines shown.

Figure 2:
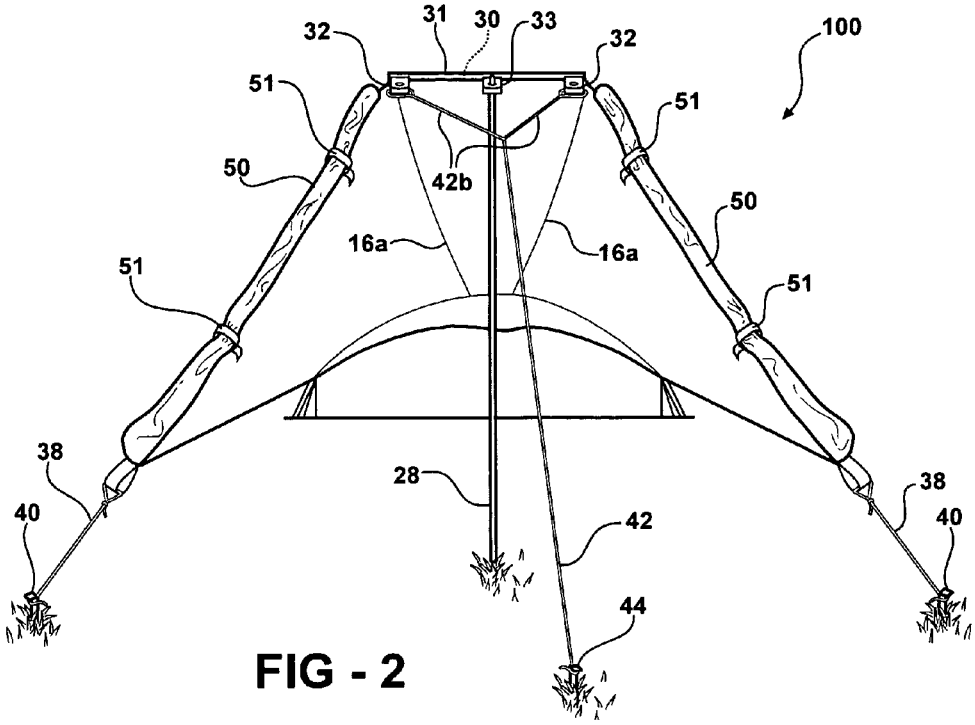
FIG. 2 is a front elevation view of the shelter of FIG. 1.
Figure 2A:
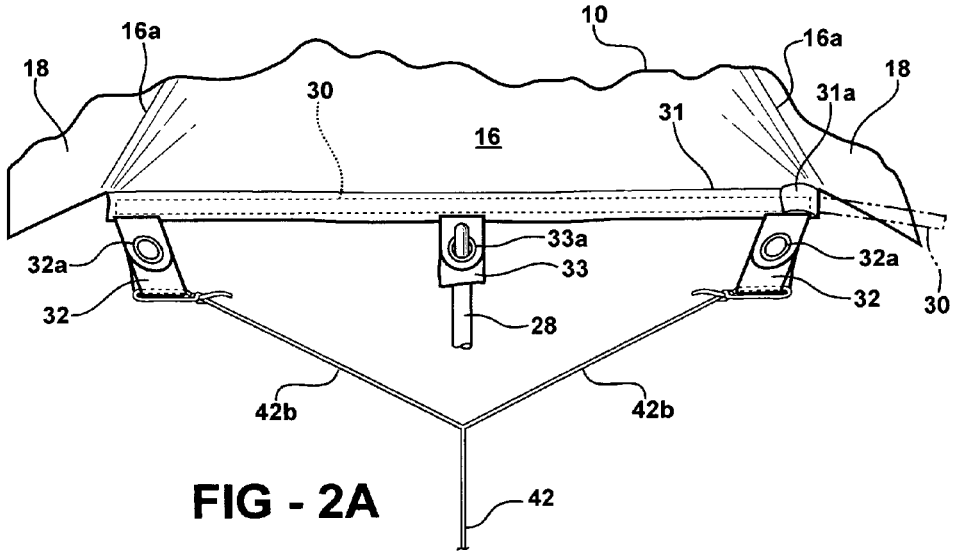
FIG. 2A is a detailed front perspective view of the ridge strut of the shelter in FIG. 1, with a single supporting pole.

The stability of shelter 100 in windy conditions when raised and tensioned as shown in FIG. 1 is greatly enhanced over prior shelters by ridge strut 30 and the tensioned catenary panel it creates in the canopy. Ridge strut 30 extends essentially horizontally across the upper end of front pole 28 and functionally connects center guyline 42 to pole 28 through pole connectors such as grommet tabs 32. Referring to FIGS. 1, 2, and 2A, ridge strut 30 is anchored to the forward upper edge of canopy 10, in the illustrated embodiment with a preferred strut sleeve 31 formed in the front edge of the canopy ridgeline panel 16. Sleeve 31 may be open at both ends to allow strut 30 to be inserted and removed from either side, closed at both ends to keep strut 30 permanently attached to the canopy, or in the preferred form illustrated closed at one end (left end in FIG. 2A) and capable of being selectively opened at the other end (right end in FIG. 2A), for example with a hook-and-loop flap closure 31*a* allowing strut 30 to be removed (see phantom lines).

Ridge strut 30 is a relatively short length (approximately eighteen inches in FIGS. 1 and 2) of suitably strong, rigid, lightweight pole material such as an aluminum alloy or carbon fiber composite of a type commonly used in making tent poles, backpack stays, and the like. It will be understood that while a hollow cylindrical strut is preferred, other shapes and cross-sections are possible. It will also be understood that while securing strut 30 to the canopy with a solid continuous pole sleeve as shown is preferred, other methods of attaching the strut to the canopy can be used. For example, the sleeve may be continuous or interrupted, or of solid or perforated fabric, or might even be replaced by multiple clip or loop structures in known manner, but the solid continuous sleeve 31 is preferred. It will also be understood that the manner of connecting pole 28 to support strut 30 can vary from the illustrated and preferred grommet tab 33, including but not limited to loop or clip connections or spaced guyline connections between the upright pole and the strut, or even direct, rigid connections between the upright pole and the strut such as pole-receiving holes formed in the strut or a strut permanently affixed to the upright pole like a "T".

While ridge strut is described and illustrated as being ideally horizontal and perpendicular to front upright pole 28, it will be understood that some variation from true horizontal is possible, and will depend on the evenness of the terrain on which the shelter is set up, the skill of the user in staking out the various guylines to evenly tension the canopy, wind conditions, and other external factors that will affect the orientation of strut 30 in use.

As best shown in FIG. 2A, strut 30 is vertically supported by center upright pole 28, and is longitudinally tensioned against the canopy by guyline 42. The essentially rigid nature of strut 30 allows it to exert an even tension along its length against canopy 10, and more particularly against ridgeline panel 16. Guyline tension on strut 30 is evenly divided between the ends of the strut, with the preferred guyline arrangement being the V- or Y-shaped split of center guyline 42 into two even-length ends 42*b* attached to end portions of the strut or pole sleeve. In the illustrated embodiment, guyline attachment is through grommeted fabric tabs 32 secured to the ends of sleeve 31. In the illustrated embodiment each tab 32 is made from a strong fabric such as nylon webbing, and includes a loop portion allowing the guyline ends to be tied on and a metal or plastic grommet of known type to receive a pole tip.

In the single-pole setup of FIGS. 2 and 2A, strut 30 has two primary planes of possible rotation relative to the pole: horizontal, around the pole axis; and vertical, in the plane of the pole axis. Strut 30 is limited in the horizontal plane by the even tension exerted on the ends of the strut through guyline splits 42*b* pulling on tabs 32. As the strut attempts to pivot under tension from the canopy in one direction, an equal and opposite force is generated through the guyline at the other end, such that the strut's tendency to rotate is self-arresting. Vertical rotation of strut 30 is inhibited by the tension exerted on the ends of the strut through the leading edges 22 of the canopy, tensioned through corner guylines 38 and stakes 40. Essentially even tension is therefore maintained on the canopy's catenary ridge panel 16 to give shelter 100 great stability even in windy conditions.

The spreading of the catenary ridgeline into a wide, essentially flat ridge panel with spaced, evenly-tensioned catenary "peaks" in the form of seams or edges 16*a* (best shown in FIG. 4) not only greatly improves stability of the canopy as a whole, but adds a significant amount of usable space and headroom for the shelter's occupants. The canopy sidewalls 18 become steeper (more vertical) for a given floor area or footprint, improving the sidewalls' resistance to sagging when wet, improving the shedding of rain and snow, increasing ventilation, and keeping condensation-wetted interior wall surfaces away from the occupants and their gear. Yet the steeper sidewalls' tensioned support by the new front pole structure and panelized catenary ridge is so markedly improved that the stability of the shelter in side winds is not compromised, as might be expected, but is better than in my previous generations of shelter. The ridgeline panel 16 narrows toward the rear end of the shelter in proportion to the narrowing width of the shelter canopy as a whole, and although in a front-to-rear narrowing shelter the panel 16 preferably extends all the way to the rear arch support for maximum stability, it may terminate at a lesser distance from the front of the shelter.

Figure 3:
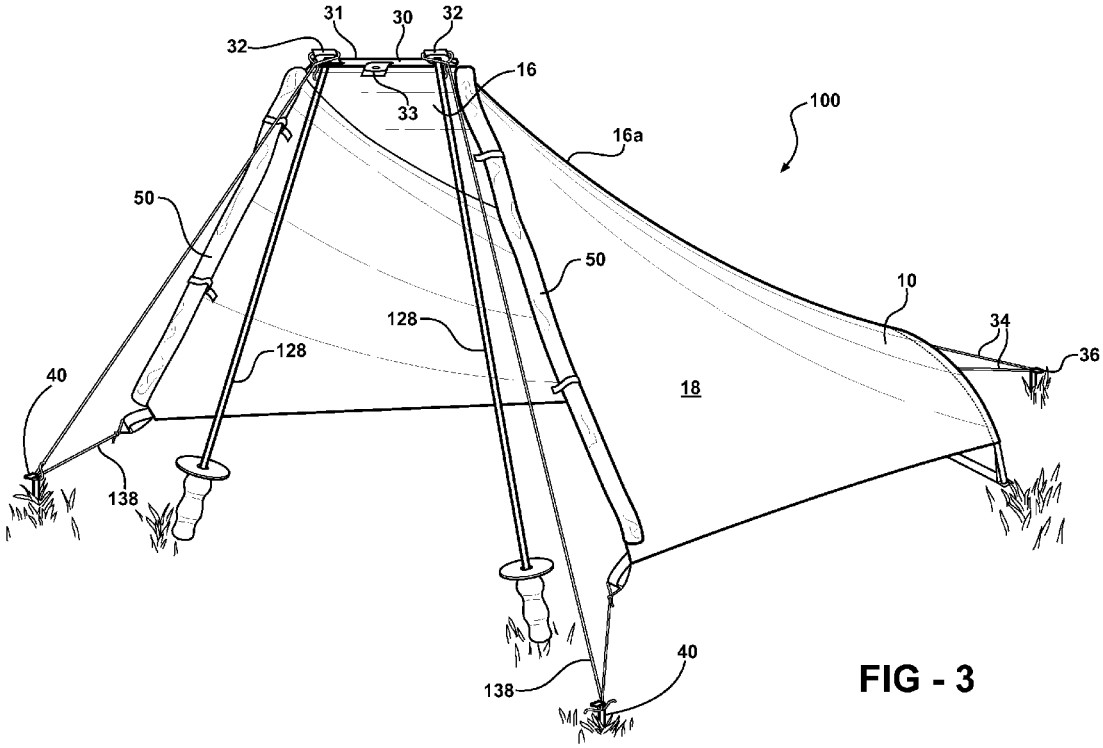
FIG. 3 is similar to FIG. 1, but shows the front of the shelter supported by two spaced poles and with an optional three-stake setup.
Figure 3A:
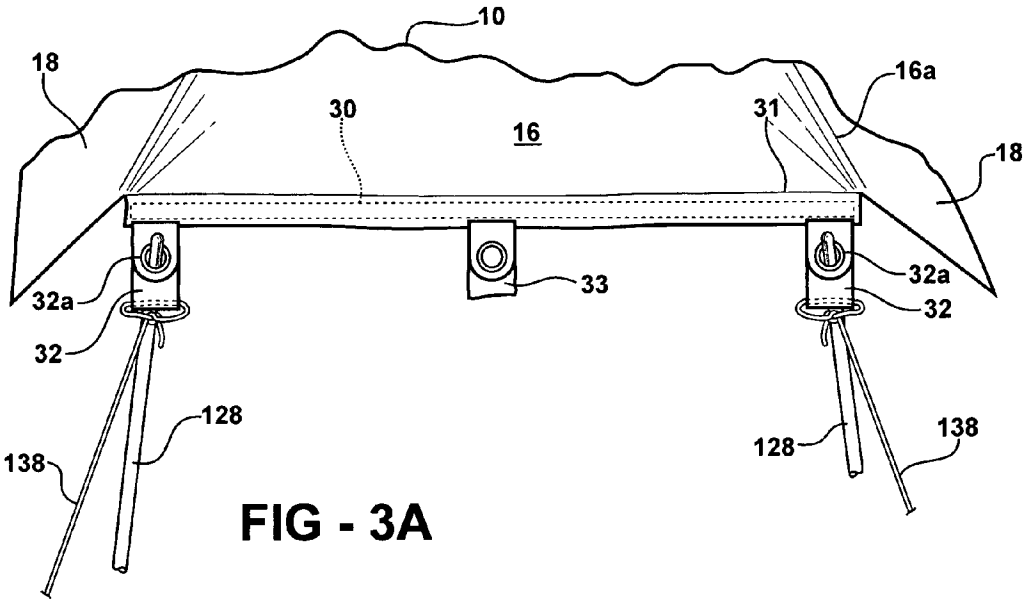
FIG. 3A is a detailed front perspective view of the ridge strut of the shelter in FIG. 1, with two supporting poles.

Referring next to FIGS. 3 and 3A, the same shelter 100 is shown with an optional and even more stable front pole setup, in which the single center pole 28 has been replaced with a pair of poles, in the illustrated embodiment a pair of trekking poles 128 of known type, commonly used by hikers and backpackers. It will be understood that the pair of poles could also be a pair of identical poles 28, ski poles, sticks of suitable length scrounged from the campsite, or any other type of pole of suitable length, weight, and strength. Trekking poles are preferred as they are strong, uniform, always at hand, often adjustable in length, and eliminate the need to carry the weight of a dedicated front support pole. It will also be understood that pole 28 could just as easily be one of the two trekking poles carried by a backpacker, a stick, etc.

Figure 4:
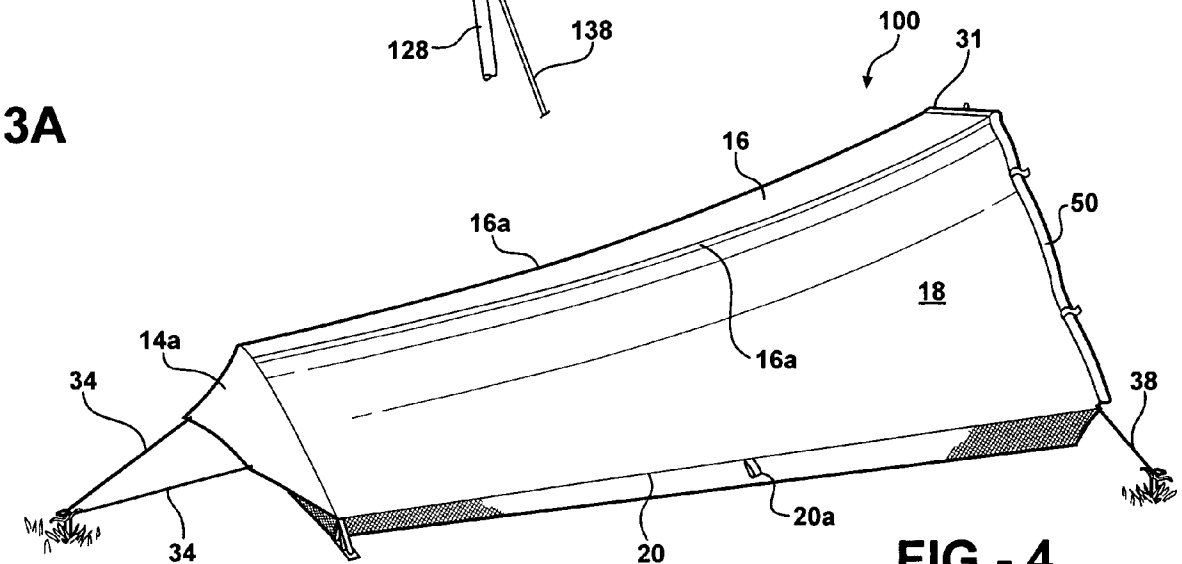
FIG. 4 is a rear perspective view of the shelter of FIG. 1.

If trekking poles are used as poles 128, the preferred manner of use is to place the trekking pole handles on the ground, and to insert the tips of the trekking poles through grommets 32*a* in end tabs 32 on pole sleeve 31. Pole sleeve 31 and its strut 30 can then be tensioned through guyline 42 with a single front stake 44 as shown in FIG. 1. Alternately, and in a preferred manner if saving weight and the number of stakes carried is critical, the center guyline 42 can be removed and replaced with modified corner guylines 138 lengthened to go around corner stakes 40 and up to tabs 32 holding the ends of poles 128. Along with the single-stake support of the rear end 14 of shelter 100 through arch 24 as shown in FIGS. 1 and 4 (and in my earlier applications), the modified guylines 138 of FIG. 3 allow the shelter to be set up with a minimum of three stakes, without lessening stability. The stability of shelter 100 with the two-pole setup of FIG. 3 is actually increased over the four-stake, single-pole setup of FIG. 1 regardless of which stake and guyline arrangement is used, since the tendency of strut 30 to twist or rotate under tension from the canopy is virtually eliminated by the spaced support of rigid poles 128 connected to each end of strut 30. The spaced poles 128 can even be used in a pinch to support and tension the front of the shelter through grommet tabs 32 and the pole sleeve if strut 30 is removed, for example if strut 30 is lost or damaged or if an ounce-counting hiker decides that the reduced stability is worth the reduction in weight.

It will be understood that two separate guylines could be connected at stake 40 to form each guyline 138, and that the single Y-shaped guyline 42 of FIG. 1 could be replaced by two separate guylines connected to one or more stakes 44. The use of two spaced front support poles 128 will affect the use of beak 50 somewhat, tending to let the forward end of the beak that would normally be clipped to center guyline 42 (the point) hang down between the poles. This slack can be fixed by separately guying the beak out from its point or lower end, or by shortening the beak so that its halves are tightly fastened together between poles 128. It will also be understood that the modified three-stake guyline setup 138 of FIG. 3 can be used with the single center pole of FIG. 1, and that the center guyline setup 42 of FIG. 1 can be used with the spaced poles of FIG. 3.

Figure 5:
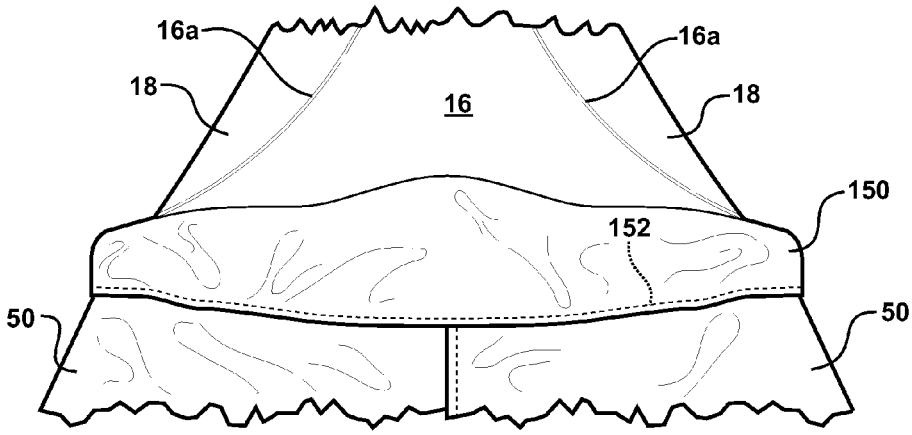
FIGS. 5 and 5A-5B are front views of the upper front end of the shelter of FIG. 1, showing a preferred adjustable ventilation flap structure supported by the ridge strut.
Figure 5A:
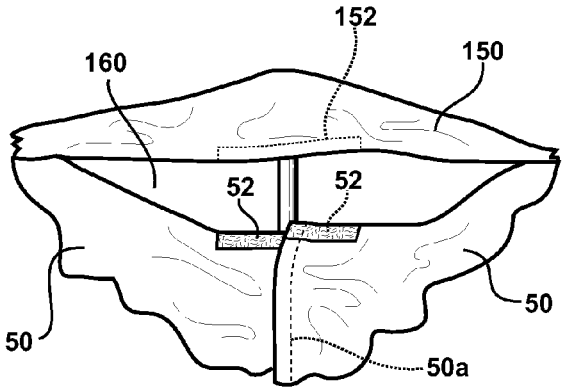
Figure 5B:
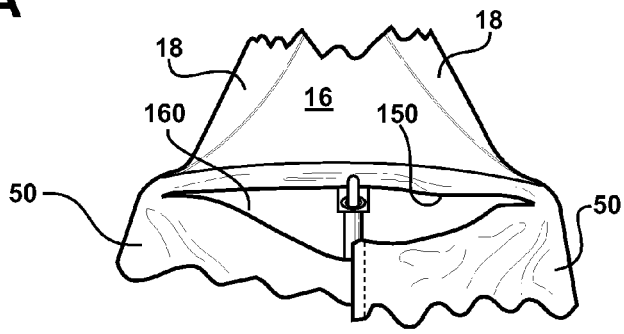

FIGS. 5 and 5A-5B show a preferred adjustable ventilation flap 150 connected to the canopy behind pole sleeve 31 and normally hanging over the pole sleeve and strut 30 and the tip(s) of the front support poles 28 or 128 to cover the junction of the beak halves 50 at the top of the shelter. Ventilation flap 150 is preferably made from the canopy material, and in the illustrated embodiment includes a connector 152 (FIG. 5A) such as hook-and-loop fastener material or a toggle to secure the upper, inner edges of beak halves 50 via mating fastener portions 52 sewn or otherwise secured on the beak halves. FIG. 5 shows beak 50 fully closed with flap 150 covering the upper junction of the beak halves for maximum weather protection but minimum ventilation. FIG. 5A shows the upper edges of beak 50 disconnected from the underside of flap 150, leaving a ventilation gap 160 that is still covered from above. FIG. 5B shows flap 150 rolled up and stashed behind the tip of pole 28 for maximum ventilation. When the beak halves are fully opened and rolled back into storage positions as shown in FIG. 3, ventilation flap 150 can simply hang over the strut assembly and tip(s) of the front support pole(s), or can be rolled up and stored as shown in FIG. 5B. It will be understood that ventilation flap 150 has been omitted from FIGS. 1-4 and FIGS. 6-7 to better show strut 30 and its connection to the front support poles.

Figure 6:
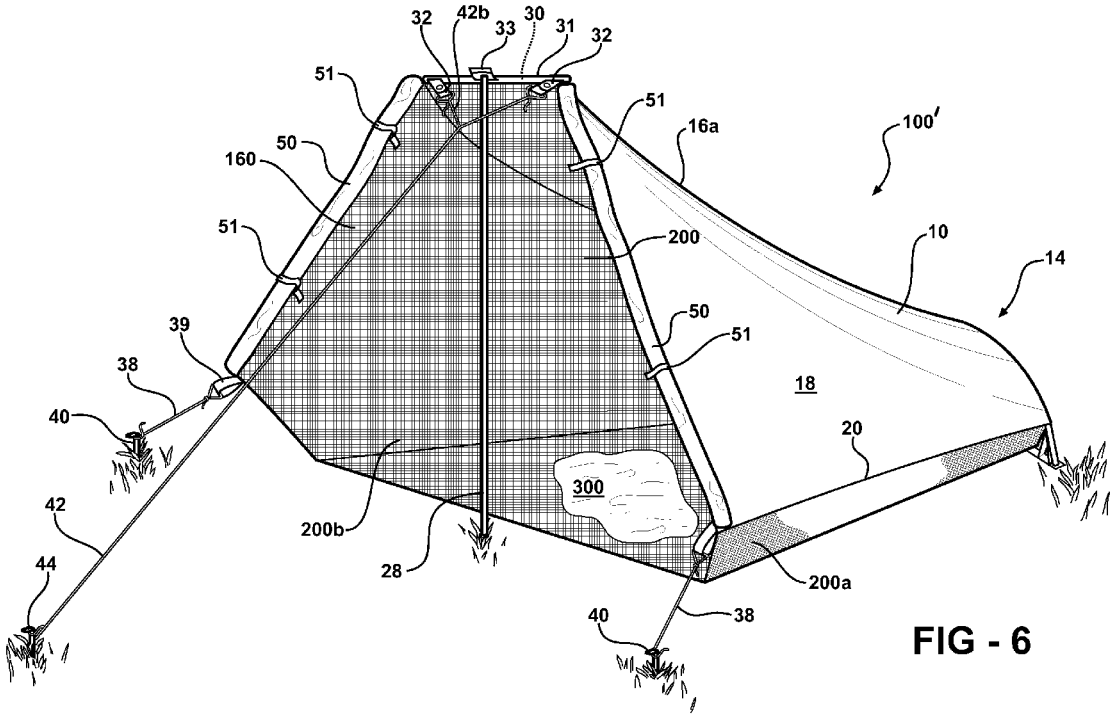
FIG. 6 is similar to FIG. 1, but shows preferred bug netting hanging from the canopy edges and front door.
Figure 7:
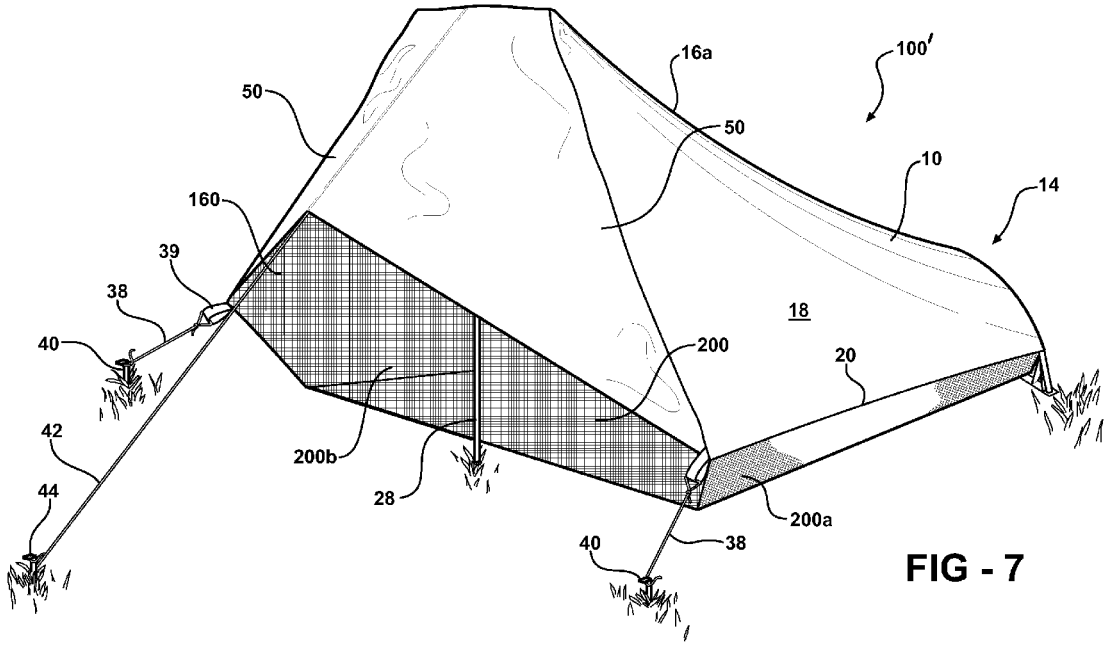
FIG. 7 shows the front beak or awning structure of the shelter of FIGS. 1 and 6, fully extended to a weather and privacy protective position.

FIGS. 6 and 7 show a shelter 100' which is essentially the same as shelter 100, but modified with preferred options including side and front door insect netting 200*a*, 200*b* hanging to the ground from the side and front edges of canopy 10, and a waterproof floor 300 connected to the netting under the canopy. The manner of attaching the insect netting and floor options to the canopy is generally disclosed in my earlier co-pending applications. In FIG. 6 the front beak 50 is fully open, with its halves rolled back and tied in place with suitable strips of hook-and-loop, straps, or cord toggles 51 in known manner. In FIG. 7 the front beak is fully closed, with both halves unrolled and connected in tension to guyline 42 as described above. FIGS. 6 and 7 merely show preferred examples of how the basic shelter 100 can be modified for different seasons or weather or privacy options without affecting the structure or performance of the waterproof canopy.

It will be understood that the disclosed embodiments are representative of presently preferred forms of the invention, but are intended to be illustrative rather than definitive of the invention. The scope of the invention is defined by the following claims.

I accordingly claim:

1. A tensioned canopy shelter for campers and backpackers, comprising:

A weather-resistant canopy comprising a rear end secured in tension and a front end raised and tensioned longitudinally against the rear end in a front-to-rear direction by a front pole support, the front pole support comprising an essentially straight vertical upright pole, the canopy comprising a horizontal ridge strut secured to the front end of the canopy generally perpendicular to the longitudinal tension of the canopy and supported off the ground by the upright pole, the canopy further comprising sidewalls separated by a catenary ridge panel with spaced catenary curve edges extending longitudinally from the horizontal ridge strut at least partway to the rear end of the canopy, the horizontal ridge strut being secured to and defining a forward end of the catenary ridge panel between the spaced catenary curve edges, and means for tensioning the horizontal ridge strut longitudinally forwardly relative to the front end of the canopy to place the catenary ridge panel in longitudinal tension between the rear end and the front pole support.

2. The shelter of claim 1, wherein the rear end of the shelter is raised and tensioned by a rear pole support.

3. The shelter of claim 2, wherein the rear end of the shelter is raised and tensioned by an arch pole support, and wherein the catenary ridge panel extends to the arch pole support.

4. The shelter of claim 1, wherein the means for tensioning the horizontal ridge strut longitudinally forward comprise a guyline attachment at each end of the ridge strut.

5. The shelter of claim 4, wherein the guyline attachments include pole connections.

6. The shelter of claim 4, wherein the horizontal ridge strut is secured to the canopy in a pole sleeve, and the guyline attachments are connected to the pole sleeve.

7. The shelter of claim 1, wherein the horizontal ridge strut includes a center pole connection.

8. The shelter of claim 1, wherein the horizontal ridge strut includes end pole connections.

9. The shelter of claim 1, wherein the horizontal ridge strut includes both center and end pole connections.

10. The shelter of claim 1, wherein the catenary ridge panel extends to the rear end of the canopy.

11. The shelter of claim 1, wherein the horizontal ridge strut is removably secured to the canopy.

12. The shelter of claim 1, wherein the horizontal ridge strut is removably secured to the canopy in a pole sleeve.

13. The shelter of claim 1, wherein the front end of the canopy includes a front closure and a ventilation flap, the ventilation flap extending from the canopy adjacent the horizontal ridge strut and overhanging an upper portion of the front closure when the front closure is closed, the ventilation flap having a free end removably attached to the front closure to selectively open and close a ventilation opening between the front closure and the catenary ridge panel.

14. The shelter of claim 13, wherein the ventilation flap is connected to the catenary ridge panel and overhangs the horizontal ridge strut.

15. The shelter of claim 1, wherein the front pole support is a single central upright pole.

16. The shelter of claim 1, wherein the front pole support is a pair of spaced upright poles connected to ends of the horizontal ridge strut.

17. The shelter of claim 1, wherein the horizontal ridge strut is adapted to receive a front pole support from the group consisting of a single center upright pole and a pair of spaced upright poles.

18. The shelter of claim 1, wherein the catenary ridge panel narrows from the front end of the canopy to the rear end of the canopy.

19. The shelter of claim 1, wherein the front end of the canopy is higher off the ground than the rear end of the canopy.

20. A tensioned canopy shelter for campers and backpackers, comprising:

A weather-resistant canopy having a lower rear end secured in tension and a higher front end raised and tensioned by a front pole support, the front pole support comprising an essentially straight vertical upright pole and a horizontal ridge strut supported off the ground by the upright pole, the canopy comprising a catenary ridgeline extending from the front pole support to the rear end, at least a forward end of the ridgeline comprising a catenary ridge panel with spaced catenary curve edges, the catenary ridge panel narrowing from the front end of the canopy to the rear end of the canopy, the ridge strut being secured to the canopy at a forward end of the catenary ridge panel between the spaced catenary curve edges, and means for tensioning the ridge strut forwardly relative to the front end of the canopy to place the catenary ridge panel in tension between the rear end and the front pole support, wherein the means for tensioning the ridge strut forwardly comprise a strut-tensioning guyline attachment at each end of the ridge strut, wherein the canopy includes a pair of forward corner canopy guyline connections at two forward lower corners of the canopy, and wherein a guyline pair comprising of one of the guyline attachments and an adjacent one of the forward corner canopy guyline connections is connected to a single stake by a single guyline.

* * * * *